US005890463A

United States Patent [19]

Speil

[11] Patent Number: 5,890,463

[45] Date of Patent: Apr. 6, 1999

[54] TAPPET WITH A HYDRAULIC VALVE CLEARANCE COMPENSATION ELEMENT

[75] Inventor: Walter Speil, Ingolstadt, Germany

[73] Assignee: INA Walzlager Schaeffler KG, Germany

[21] Appl. No.: 946,444

[22] Filed: Oct. 7, 1997

Related U.S. Application Data

[62] Division of Ser. No. 849,597, May 27, 1997, Pat. No. 5,727,509.

[30] Foreign Application Priority Data

Dec. 14, 1994 [DE] Germany ..... 44 44 481.8

[51] Int. Cl.[6] ..... F01L 1/18; F01L 1/24

[52] U.S. Cl. ..... 123/90.46; 74/559

[58] Field of Search ..... 123/90.39, 90.45, 123/90.46, 90.48, 90.49, 90.55; 74/519, 559, 569

[56] References Cited

U.S. PATENT DOCUMENTS

| | | | |
|---|---|---|---|
| 2,036,936 | 4/1936 | Halford | 123/90.46 |
| 4,502,428 | 3/1985 | Paar | 123/90.46 |
| 4,624,224 | 11/1986 | Kodama et al. | 123/90.46 |
| 4,756,282 | 7/1988 | Kunz et al. | 123/90.55 |
| 4,856,468 | 8/1989 | Speil et al. | 123/90.46 |

FOREIGN PATENT DOCUMENTS

| | | |
|---|---|---|
| 0030781 | 6/1981 | European Pat. Off. . |
| 7740150 | 6/1979 | Germany . |
| 3006644 | 9/1981 | Germany . |
| 3304398 | 8/1984 | Germany . |
| 2162608 | 2/1986 | United Kingdom . |

OTHER PUBLICATIONS

Patent Abstracts of Japan vol. 10, No. 286 Sep. 1986 &JP–A–61 104110 May 22, 1986.

*Primary Examiner*—Weilun Lo
*Attorney, Agent, or Firm*—Bierman, Muserlian and Lucas

[57] ABSTRACT

The clearance compensation element (5) of a lever (26) is retained axially within a bore (27). An end of the bore (27) comprises a diameter enlargement (29) in which a Belleville-type spring washer (16) with a radially outwards acting retention force is arranged to achieve a positioning of a pressure piston (7) of the clearance compensation element (5).

5 Claims, 3 Drawing Sheets

TAPPET WITH A HYDRAULIC VALVE CLEARANCE COMPENSATION ELEMENT

PRIOR APPLICATION

This application is a division of U.S. patent application Ser. No. 849,597 filed May 27, 1997, now U.S. Pat. No. 5,727,509.

The invention concerns a cam follower in the form of a tappet or a lever for a valve drive of an internal combustion engine comprising a hollow cylindrical housing (2) with which the tappet (1) oscillates in a reception bore of a cylinder head, one end (3) of the tappet being closed by a disc-like bottom (4) while a hydraulic clearance compensation element (5) is arranged concentric to the housing (2) in the tappet (1), said clearance compensation element (5) comprising a cylindrical guide element (6) which bears against the bottom (4) and is arranged in a bore of an axially displaceable pressure piston (7) whose bottom (8) faces a gas exchange valve, an annular guide element (10) starting from an inner peripheral surface (9) of the housing (2) merges radially inwardly into a hollow cylindrical axial extension (11) pointing in cam-remote direction and in whose bore (12) the pressure piston (7) extends, the bottom (8) of the pressure piston (7) having a reduced diameter (13) which cooperates with an annular retention element extending radially inwards from an end of the axial extension (11), the guide element (10) comprising a diameter enlargement (14) on one end in which the retention element having a substantially radially outwards acting retention force is fixed by at least one of force engagement and positive engagement.

A tappet of the generic type is known from EP-A 30 781. The axial extension in this tappet starts from the guide element and is relatively thick-walled and of a solid configuration (see e.g. FIG. 6). An additional, separate annular groove is provided in a bore of the axial extension for fixing the clearance compensation element in cam-remote direction. A locking ring is arranged in this annular groove to prevent the clearance compensation element from falling out in cam-remote direction. A drawback of this prior art tappet is that the relatively solid configuration of the axial extension and the guide element unnecessarily increases the mass of the tappet. The machining of the groove is not only unfavorable with regard to manufacturing costs but it also weakens the cross-section of the axial extension so that material has to be added at another point to obtain the required strength.

Further, GB-A 21 62 680 discloses, for example, in FIG. 1, a lever-type cam follower having a clearance compensation element which is fixed in cam-remote direction by a separate locking ring. One drawback of this solution is that the lower end has a relatively solid configuration which has a negative influence on the overall mass of the cam follower. A further drawback is the additional work step required for making the groove for the locking ring.

It is therefore an object of the invention to create a tappet and a lever-type cam follower of the pre-cited type in which the mentioned drawbacks are eliminated and which furnishes a low-cost and easily implementable retention of the clearance compensation element in cam-remote direction while at the same time minimizing the danger of clamping of the clearance compensation element.

In one embodiment, the guide element together with its axial extension is made as a separate thin-walled component, a tappet with a simple retention means for its clearance compensation element is created which is particularly advantageous as regards its total mass, while the retention means for the hydraulic element is simple to manufacture. Fixing of the guide element on the housing can be achieved, for example, by swaging, welding, gluing, roller burnishing and the like. Due to the fact that the retention element in the form of a ring or a Belleville-type spring washer with a radially outwards acting retention force is fixed in a diameter enlargement, a simple means is created for preventing the pressure piston of the clearance compensation element from clamping on the retention element during its axial clearance compensating motion. Because the diameter enlargement is an integral part of the axial extension of the guide element, or of the bore of the lever-type cam follower, the additional step of making a fixing groove for the respective retention element can be dispensed with in both cases.

Advantageously, the spring washer is pressed into the bore of the axial extension, and its retention force can be enhanced by the features of the invention. Due to the Belleville-type configuration of the washer, it is guaranteed in all cases that the force required for pressing in the retention element is weaker than its retention force in axial direction.

The alternative ring is made preferably of a spring steel, but it is also conceivable to make it of a non-ferrous metal or of a polymeric material. Advantageously, the ring is surrounded by a bulge on the end of the axial extension and is thus prevented from being pressed out by the pressure piston of the clearance compensation element during transport or operation of the valve drive tappet. It is not necessary that an inwards pointing end face of the end of the bulge be aligned to the bore of the axial extension in which the pressure piston is received because this proves to be disadvantageous from the manufacturing point of view. What is important, however, is, that at least a part of the cam-distal peripheral surface of the ring be surrounded by the bulge. To intensify the retaining action of the ring in the bulge, the ring can be retained, for example, by gluing or by sharp-edged portions on the bulge itself or on the ring.

To facilitate the mounting of the spring washer-type retention element, an end of the diameter enlargement can comprise a radially outwards bent insertion heel or, alternatively, an end of the axial extension can be bent over outwards through 180°.

To positionally fix the clearance compensation element, particularly in the bore of the lever-type cam follower, the bore of the spring washer-type retention element can comprise a flat region which cooperates with a facing flat region on an end of the pressure piston to prevent rotation.

The bore in both configurations of the retention element is made to have play relative to the region of reduced diameter of the pressure piston to assure a smooth axial movement of the pressure piston in every state of operation of the internal combustion engine.

The invention is not limited to the features recited in the claims. Rather, combinations of individual features of the claims and combinations of individual claimed features with the disclosures made in the discussion of advantages and in the description of the embodiments of the invention are both conceivable and intended.

Referring now to the drawings.

Figure 3A:
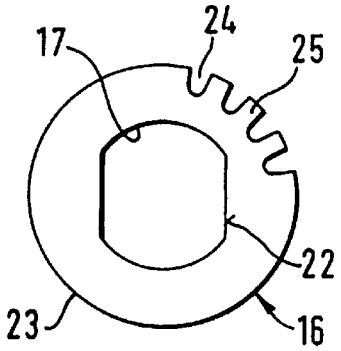
Figure 3B:
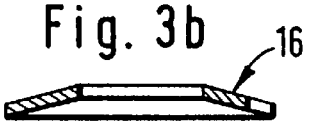
Figure 4:
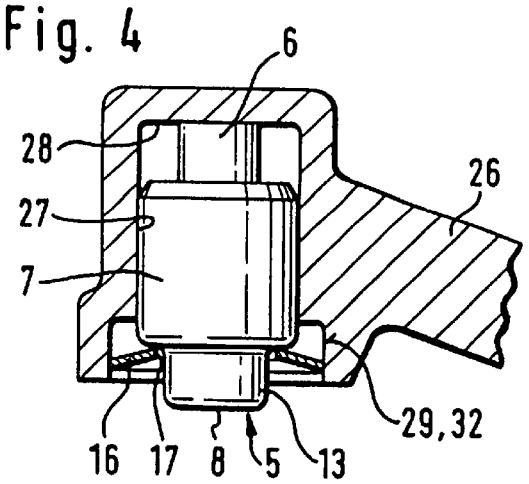
Figure 5A:
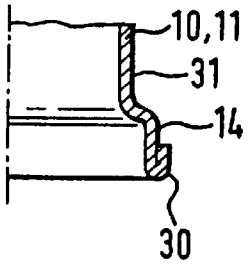
Figure 5B:
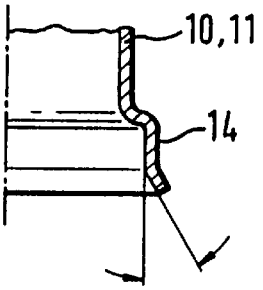
Figure 6:
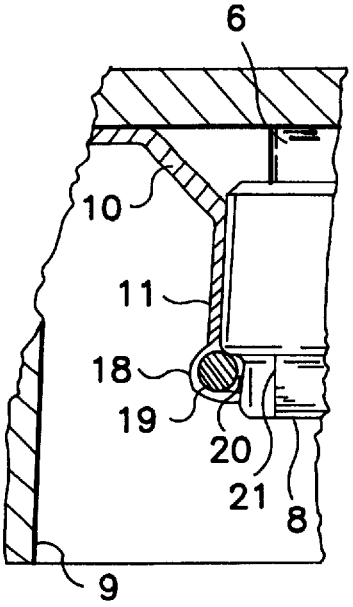

FIGS. 3*a* and 3*b* show the Belleville-type spring washer;

FIG. 4 is a partial view of the lever-type cam follower;

FIGS. 5*a* and 5*b* show special configurations of the end of the axial extension;

FIG. 6 is a partial view of the cam follower showing the diameter enlargement of an axial extension (11).

Figures 1A, 1B:
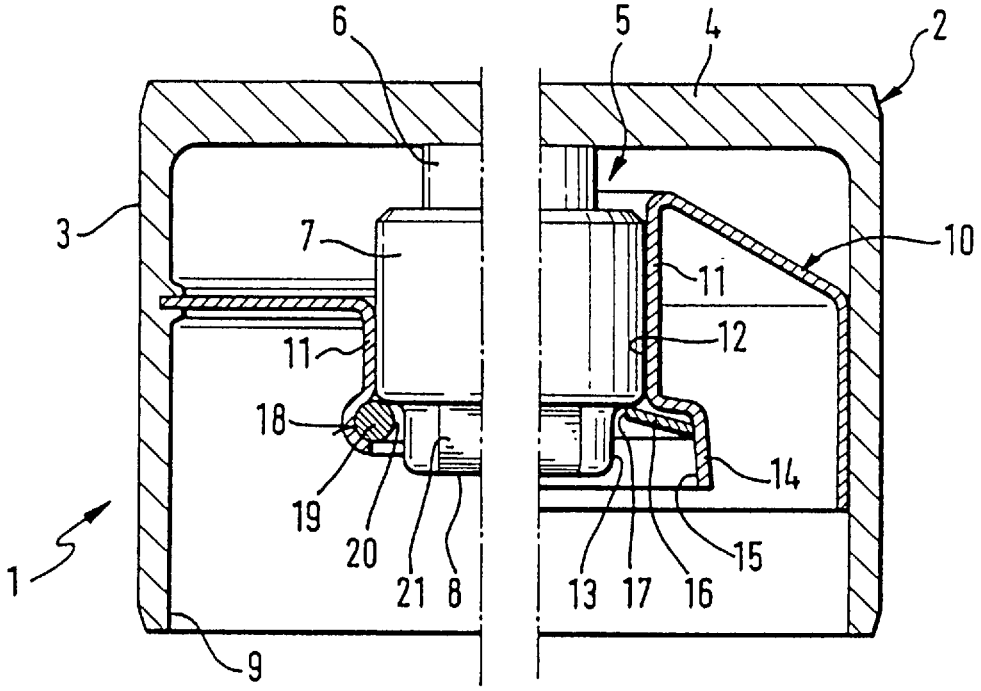
FIGS. 1A and 1B are a longitudinal cross-section through a tappet.

FIGS. 1A and 1B show a tappet 1 for a valve drive of an internal combustion engine. The tappet 1 comprises a hollow cylindrical housing 2 which is closed at one end 3 by a disc-like bottom 4. Arranged concentric to the housing 2 within the tappet 1 is a hydraulic clearance compensation element 5 comprising a cylindrical guide element 6 which bears against the bottom 4. The guide element 6 is received in a bore of an axially displaceable pressure piston 7 whose bottom 8 faces a gas exchange valve, not shown. An annular guide element 10 extends from an inner peripheral surface 9 of the housing 2 to merge radially inwardly into a hollow cylindrical axial extension 11 extending in cam-remote direction. The left and right halves of FIGS. 1A and 1B show different configurations of the guide element 10. The pressure piston 7 is arranged for axial displacement in a bore 12 of the axial extension 11.

In the region of its bottom 8, the pressure piston 7 comprises a reduced diameter 13. A cam-distal end of the axial extension 11 is configured with a generally funnel-shaped diameter enlargement 14 (right half of the figure). This diameter enlargement 14, as also the entire guide element 10, is made with a thin wall and has the same wall thickness as the rest of the guide element 10. A Belleville-type spring washer 16 is pressed into a bore 15 of the diameter enlargement 14, and a bore 17 of the washer 16 extends with slight play relative to the reduced diameter 13 of the pressure piston 7.

FIG. 1A shows an alternative configuration of the washer 16. The diameter enlargement 14 in this case is made in the form of a bulge and the retention element for the pressure piston 7 in this embodiment is a ring 19 inserted into a groove 18 of the bulge. The ring 19 is retained in the bulge mainly by positive engagement. A bore 20 of the ring 19 is again configured with slight play relative to the reduced diameter 13 of the pressure piston 7.

As can be further seen in FIGS. 1A and 1B, the bottom region of the pressure piston 7 can comprise a flat region 21 which cooperates with a flat region 22 (see FIG. 3) of the washer 16. This is a simple means for preventing rotation of the pressure piston 7 which can be particularly important when it is necessary to mount the tappet 1, secure against rotation, in an inclined position in the cylinder head. This rotation-prevention means also assures a directed supply of hydraulic medium to the interior of tappet 1.

The washer 16 or the ring 19, as the case may be, together with the thin-walled axial extension 11 constitutes a simple means for limiting the axial displacement of the pressure piston 7 of the clearance compensation element 5, in particular during transportation of the tappet 1. At the same time, additional manufacturing steps for installing the retention element on the guide element 10, or more exactly on the axial extension 11, can be dispensed with.

Figure 2:
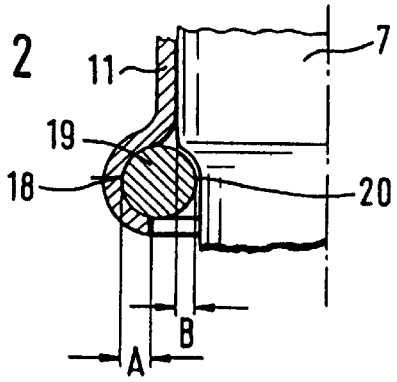
FIG. 2 is a detail showing a retention element in the form of a ring received in a bulge of the axial extension.

FIG. 2 is an enlarged detail showing the bulge of the axial extension 11 represented in FIG. 1A. To prevent the ring 19 form being pressed out of its groove 18 in cam-remote direction during an axial displacement of the pressure piston 7, the ratio between the spacing dimensions A and B shown in FIG. 2 should be A:B >1.

In FIG. 3, it can be seen further that it is possible to make recesses 24 on the outer peripheral surface 23 of the washer 16 so that tongues 25 are formed between the recesses 24. These tongues 25 enhance the retaining force of the washer 16 in the bore 15. As an alternative, it is conceivable to provide sharp edges on the outer periphery 23 of the washer 16.

FIG. 4 illustrates an alternative use of the axial safety device of FIGS. 1A and 1B against loss of the pressure piston 7. FIG. 4 shows a lever-type cam follower 26 (rocker arm), one end of which comprises a bore 27 which is open in valve direction. Here again, the clearance compensation element 5 with its components 6 and 7, shown in FIGS. 1A and 1B, is arranged in the bore 27. The guide element 6 is supported on a bottom 28 of the bore 27. The bottom 8 of the pressure piston 7 again faces a gas exchange valve, not shown, and the bottom 8 likewise comprises a reduced diameter 13. This reduced diameter 13 is arranged radially opposite the diameter enlargement 29 of the bore 27 of the cam follower 26. As described above, the washer 16 is again arranged in the bore 29. It is advantageous, particularly in this use, to implement the rotation-preventing measures shown in FIG. 3. The washer 16 is again configured so that its bore 17 has a slight play relative to the reduced diameter 13 of the pressure piston 7 to thus assure a smooth axial movement of the pressure piston 7.

It is equally conceivable to use the device of FIG. 2 in the cam follower of FIG. 4. In this case, the diameter enlargement formed integrally on the cam follower could be omitted and a separate, thin-walled element 11 according to FIG. 2 could be fixed on this end to optionally receive the ring 19 or the washer 16. Alternatively, it is also possible to make the diameter enlargement 29 integrally on the cam follower 26 but as thin-walled as shown in FIGS. 1A, 1B and 2.

Finally, FIGS. 5*a* and 5*b* show measures for reinforcing axial extension 11 of the guide element 10 at its the cam-distal end. According to FIG. 5*a*, an end 30 of the axial extension 11 is turned over radially outwards through 180° and bears against the outer peripheral surface 31 of the axial extension 11. This makes the end of the diameter enlargement 14 less susceptible to wear while, at the same time, creating an insertion heel for the pressure piston 7. As an alternative, as shown in FIG. 5*b*, the end 30 of the axial extension 11 can be bent radially outwards at a slight angle to form an insertion heel. As shown in FIG. 6, the annular guide element (10) may start from the inner surface of the bottom (4) to merge radially inwardly into the hollow cylindrical axial extension (11) pointing in a cam-remote direction.

I claim:

1. A cam follower in the form of a lever (26) of a valve drive of an internal combustion engine comprising a bore (27) in one end, the bore (27) is open in a valve direction and serves to receive a hydraulic clearance compensation element (5) comprising a cylindrical guide element (6) which bears against a bottom (28) of the bore (27) while being arranged in a bore of an axially displaceable pressure piston (7) whose bottom (8) faces a gas exchange valve and whose outer peripheral surface extends in the bore (27) of the cam follower (26), one end of the bore (27) comprising an annular retention element radially inwards of which extends a region of reduced diameter (13) of the bottom (8) of the pressure piston (7), the one end of the bore (27) comprising a diameter enlargement (29) in which the retention element having a substantially radially outwards acting retention force is fixed by at least one of force engagement and positive engagement, characterized in that the diameter enlargement (29) of the end of the bore (27) has an approximately funnel-shaped configuration, and the retention element is a Belleville-type spring washer (16) arranged in the bore (32), while the bottom (8) of the pressure piston (7) extends with a slight play in a bore (17) of the washer (16).

2. A cam follower of claim 1 wherein the washer (16) is pressed into the bore (15, 32) of the diameter enlargement (29) of the bore (27).

3. A cam follower of claim 1 wherein at least one peripheral section of the bore (17) of the washer (16) is unrecessed to form at least one flat region (22) which cooperates with a corresponding flat region (21) of the reduced diameter (13) of the pressure piston (7).

4. A cam follower of claim 1 wherein an outer peripheral surface (23) of the washer (16) comprises sharp edges.

5. A cam follower of claim 1 wherein recesses (24) are made on the outer peripheral surface (23) of the washer (16) so that tongues (25) are formed between the recesses (24).

* * * * *